US008303270B2

(12) United States Patent
Iguchi et al.

(10) Patent No.: US 8,303,270 B2
(45) Date of Patent: Nov. 6, 2012

(54) MOTOR-DRIVEN COMPRESSOR

(75) Inventors: Masao Iguchi, Kariya (JP); Masahiro Kawaguchi, Kariya (JP); Ken Suitou, Kariya (JP); Tatsushi Mori, Kariya (JP); Hiroshi Fukasaku, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 608 days.

(21) Appl. No.: 12/333,980

(22) Filed: Dec. 12, 2008

(65) Prior Publication Data

US 2009/0162221 A1 Jun. 25, 2009

(30) Foreign Application Priority Data

Dec. 18, 2007 (JP) ..... P2007-326416

(51) Int. Cl.
*F04B 39/06* (2006.01)
*F04B 39/02* (2006.01)

(52) U.S. Cl. ..... 417/371; 417/410.5; 62/505

(58) Field of Classification Search ..... 417/366, 417/371, 410.5; 62/505, 259.2
See application file for complete search history.

(56) References Cited

U.S. PATENT DOCUMENTS 6,321,563 B1 * 11/2001 Ikeda et al. ..... 62/505
6,511,295 B2 * 1/2003 Suitou et al. ..... 417/44.1
6,524,082 B2 * 2/2003 Morita et al. ..... 417/371
6,564,576 B2 * 5/2003 Shibuya ..... 62/505
6,599,104 B2 * 7/2003 Saito et al. ..... 417/366
6,619,933 B2 * 9/2003 Ikeda ..... 417/410.1

FOREIGN PATENT DOCUMENTS

JP 2002-180984 A 6/2002
JP 2004-324494 11/2004
JP 2005-146862 A 6/2005
JP 2005-282550 A 10/2005
JP 2005-282551 A 10/2005
JP 2006-037726 A 2/2006
JP 2007-292044 A 11/2007

OTHER PUBLICATIONS

Office Action in corresponding Chinese application with English translation issued Apr. 25, 2011.
Chinese Office Action with English translation issued May 26, 2010.
Japanese Office Action for Application No. 2007-326416, issued on Sep. 13, 2011.

* cited by examiner

*Primary Examiner* — Peter J. Bertheaud
(74) *Attorney, Agent, or Firm* — Locke Lord LLP

(57) ABSTRACT

A motor-driven compressor includes a housing having an inlet port, a compression mechanism for compression of refrigerant introduced from an external refrigerant circuit via the inlet port into the housing, an inverter having a heat-generating component, an electric motor driven by the inverter, and a rotary shaft rotated by the electric motor thereby to drive the compression mechanism. The electric motor, the compression mechanism and the inverter are aligned in the housing in axial direction of the rotary shaft. An inlet pipe is connected to the inlet port. The housing has an outer peripheral surface in contact with the inlet pipe. The heat-generating component of the inverter is disposed adjacent to or in contact with the inlet pipe so as to be thermally coupled to the inlet pipe.

7 Claims, 2 Drawing Sheets

MOTOR-DRIVEN COMPRESSOR

BACKGROUND OF THE INVENTION

The present invention relates to a motor-driven compressor having an electric motor, a compression mechanism and an inverter aligned in a housing in axial direction of a rotary shaft of the compressor.

In such compressor, the motor is controlled by the inverter. The motor needs to be supplied with a large amount of power from the inverter to operate the compression mechanism. In the inverter, switching operation of switching devices (heat-generating components) is frequently performed, so that a large amount of heat is generated. Therefore, cooling of the inverter is required in such compressor in order to maintain the proper operation of the inverter.

A compressor with a cooling mechanism for the inverter is disclosed, for example, in Japanese Unexamined Patent Application Publication No. 2001-263243. The compressor includes a hermetic housing of a cylindrical shape. The housing accommodates therein a compression mechanism, a motor, and a rotary shaft coupling the compression mechanism to the motor. The compression mechanism, the motor and the rotary shaft are aligned in the longitudinal direction of the housing. The housing is formed with a cylindrical heatsink for cooling the inverter. The heatsink is provided integrally at the housing end adjacent to the motor. The heatsink is formed at the outer periphery thereof with a plurality of flat mount surfaces. Heat-generating components of the inverter are fixedly mounted on such mount surfaces so that the heat transfer is allowed. The heatsink and the inverter are covered with a protector. The heatsink is disposed so as to extend over the entire axial length of the inner space of the protector, and the inverter is located between the heatsink and the protector.

In the compressor, while the inverter supplies power to the motor, heat is generated in the inverter. The heat is transferred to the heatsink and radiated into the atmosphere. The heat is also transferred from the heatsink to the housing and radiated. Since the heat transferred to the heatsink is absorbed by refrigerant flowing through the inner space of the heatsink, the heat is efficiently radiated. As a result the inverter is cooled.

In the compressor, however, since the heatsink is disposed so as to extend over the entire axial length of the inner space of the protector, arrangement of the inverter in the space of the protector is not flexible. In addition, the shape of a circuit board of the inverter is also not flexible, accordingly inverter design is not flexible.

The present invention is directed to providing a motor-driven compressor with improved efficiency of cooling of heat-generating components and is expanded inverter design freedom.

SUMMARY OF THE INVENTION

In accordance with an aspect of the present invention, a motor-driven compressor includes a housing having an inlet port, a compression mechanism for compression of refrigerant introduced from an external refrigerant circuit via the inlet port into the housing, an inverter having a heat-generating component, an electric motor driven by the inverter, and a rotary shaft rotated by the electric motor thereby to drive the compression mechanism. The electric motor, the compression mechanism and the inverter are aligned in the housing in axial direction of the rotary shaft. An inlet pipe is connected to the inlet port. The housing has an outer peripheral surface in contact with the inlet pipe. The heat-generating component of the inverter is disposed adjacent to or in contact with the inlet pipe so as to be thermally coupled to the inlet pipe.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
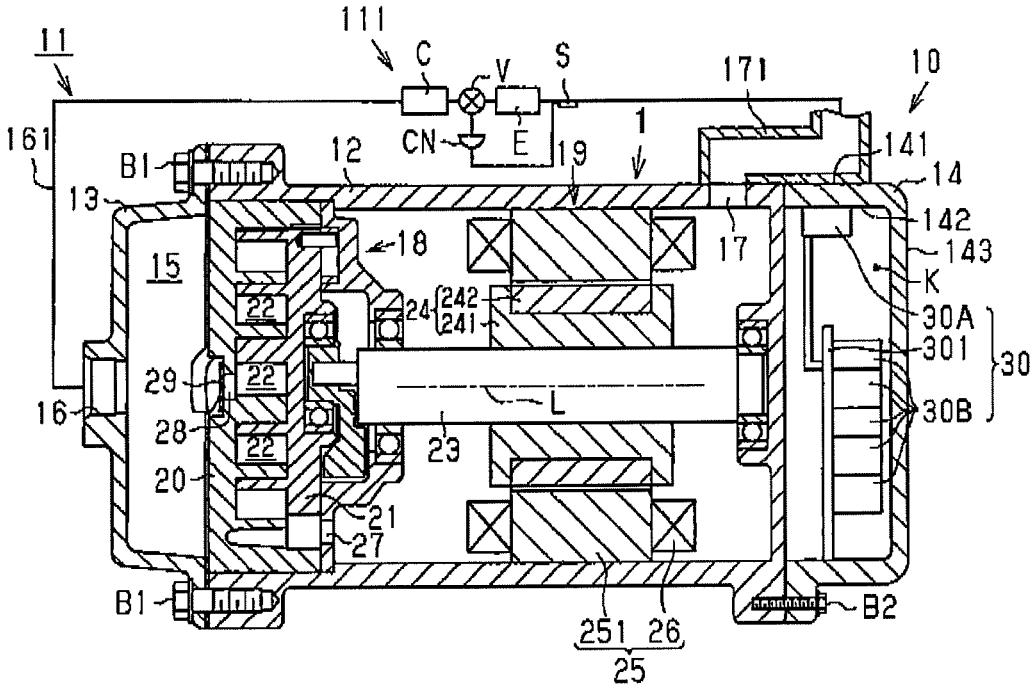
FIG. 1 is a longitudinal cross-sectional view of a motor-driven compressor according to a first embodiment of the present invention.
Figure 2:
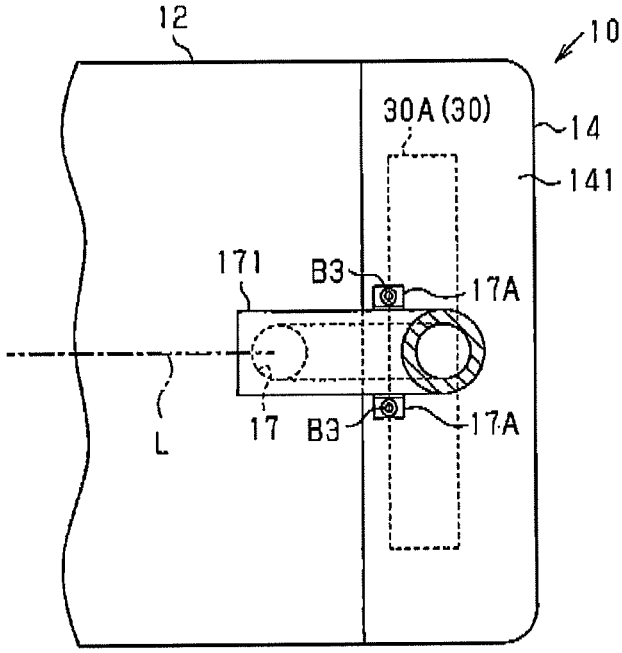
FIG. 2 is a plan view of an inlet pipe connected to the motor-driven compressor of FIG. 1.

The following will describe the first embodiment of the present invention with reference to FIGS. 1 and 2. FIG. 1 shows a motor-driven compressor 10 (hereinafter referred to a compressor 10) of the first embodiment. The compressor 10 is used in a refrigeration circuit 11 of a vehicle air conditioner. It is noted that the right-hand side as viewed in FIG. 1 is the front side of the compressor 10 and the left-hand side is the rear side of the compressor 10.

Referring to FIG. 1, the refrigeration circuit 11 includes an external refrigerant circuit 111 and the compressor 10. The external refrigerant circuit 111 has a condenser C, an expansion valve V and an evaporator E. In refrigeration circuit 11, high-pressure and high-temperature refrigerant gas from the compressor 10 is cooled and condensed by the condenser C. The flow of the refrigerant from the condenser C is controlled by the expansion valve V. The refrigerant from the expansion valve V is evaporated in the evaporator E. The external refrigerant circuit 111 is provided with a temperature sensor S and a controller CN. The temperature sensor S detects the temperature of the refrigerant from the evaporator E. The controller CN is connected to the expansion valve V for controlling the opening of the expansion valve V in response to a signal from the temperature sensor S.

The compressor 10 has a housing assembly 1 (hereinafter referred to as a housing 1) composed of an intermediate housing 12, a rear housing 13 and a front housing 14. The intermediate housing 12 is connected at the rear end thereof to the rear housing 13 via five bolts B1 (only two bolts are shown in FIG. 1), and connected at the front end thereof to the front housing 14 via five bolts B2 (only one is shown). The intermediate housing 12 accommodates therein a compression mechanism 18 and an electric motor 19 driving the compression mechanism 18 for compression of refrigerant gas.

The compression mechanism 18 includes a fixed scroll 20 and a movable scroll 21. The fixed scroll 20 is mounted on the intermediate housing 12. The movable scroll 21 is disposed so as to face the fixed scroll 20 to form a compression chamber 22 therebetween, the volume of which is variable. The movable scroll 21 is coupled to a rotary shaft 23 rotatably supported by the intermediate housing 12.

The electric motor 19 (hereinafter referred to as the motor 19) includes a rotor 24 and a cylindrical-shaped stator 25. The rotor 24 is mounted on the rotary shaft 23 for rotation therewith in the intermediate housing 12. The rotor 24 has a rotor core 241 mounted on the rotary shaft 23 and permanent magnets 242 mounted on the rotor core 241. The stator 25 has a stator core 251 and a coil 26. The stator core 251 is mounted on the inner peripheral surface of the intermediate housing 12. The coil 26 is wound on the teeth (not shown in the drawing) of the stator core 251.

The rear housing 13 forms therein a discharge chamber 15. The rear housing 13 has a discharge port 16 at the rear end. The front housing 14 forms therein an accommodation space K. The intermediate housing 12 has an inlet port 17 at the periphery thereof adjacent to the front housing 14. The refrigeration circuit 11 has an inlet pipe 171 and a discharge pipe 161. The inlet pipe 171 is disposed downstream of the evaporator E in the external refrigerant circuit 111 and connects the inlet port 17 to the outlet of the evaporator E. The discharge pipe 161 is disposed upstream of the evaporator E in the external refrigerant circuit 111 and connects the discharge port 16 to the inlet of the condenser C.

The inlet pipe 171 is made of a metal and connected at one end thereof to the inlet port 17 and at the other end thereof to the outlet of the evaporator E. Part of the inlet pipe 171 adjacent to the one end thereof extends approximately straight in the axial direction of the rotary shaft 23 from the inlet port 17 toward the front housing 14. Part of the outer surface of the inlet pipe 171 is in contact with the front-side outer peripheral surface of the intermediate housing 12 and the outer peripheral surface 141 of the front housing 14. The inlet pipe 171 extends to a position adjacent to the front end 143 of the front housing 14 and then is bent outwardly from the front housing 14.

Referring to FIG. 2, the inlet pipe 171 is provided with plural brackets 17A (two in the embodiment). Each bracket 17A has an L shape as viewed in the axial direction of the rotary shaft 23 and is mounted on the outer peripheral surface 141 of the front housing 14 by using a bolt B3. The inlet pipe 171 is thus fixedly mounted on the front housing 14, and thermally coupled to the intermediate housing 12 and the front housing 14 so that heat transfer is allowed.

Referring to FIG. 1, the front housing 14 accommodates in the accommodation space K thereof an inverter 30. The inverter 30 is electrically connected to the motor 19 via a harness (not shown in the drawing) and supplies power to the motor 19. The inverter 30 includes a circuit board 301 and electronic components 30A and 30B. The circuit board 301 is mounted on the front housing 14, and the electronic components 30A and SOB are mounted on the circuit board 301. The electronic component 30A, which is as a heat-generating component of the inverter 30, is a switching device. The electronic components 30B are known components such as electrolytic capacitors, transformers, driver ICs, diodes and resistors. The electronic element 30A is mounted on the inner peripheral surface 142 of the front housing 14 at a position on the opposite side of a wall of the front housing 14 from the inlet pipe 171. That is, the electronic component 30A is thermally coupled to the inlet pipe 171 via the wall of the front housing 14.

In the embodiment, the compression mechanism 18, the motor 19 and the inverter 30 are aligned in the housing 1 along the axis L of the rotary shaft 23.

In the above-described compressor 10, when power is supplied to the motor 19 from the inverter 30, the rotor 24 of the motor 19 is rotated with the rotary shaft 23 thereby to drive the compression mechanism 18. While the compression mechanism 18 is in operation, the volume of the compression chamber 22 between the scrolls 20 and 21 is varied, and refrigerant gas is introduced from the evaporator E via the inlet pipe 171 and the inlet port 17 into the intermediate housing 12. The refrigerant gas then flows via an inlet passage 27 into the compression chamber 22 and compressed therein. After being compressed, the refrigerant gas is discharged via a discharge passage 28 into the discharge chamber 15 while pushing open a discharge valve 29, and flows out of the compressor 10 into the discharge pipe 161. The refrigerant then flows through the external refrigerant circuit 111, flowing back into the intermediate housing 12.

When the compressor 10 is in operation, the inverter 30, particularly the electronic component 30A generates heat during switching operation, and such heat is transferred to the inlet pipe 171 through the wall of the front housing 14. The heat is absorbed by refrigerant gas flowing in the inlet pipe 171, so that the electronic component 30A is efficiently cooled.

The motor-driven compressor 10 according to the first embodiment offers the following advantages.

(1) Part of the inlet pipe 171 adjacent to the one end thereof is disposed extending along and in contact with the outer peripheral surface 141 of the front housing 14. The electronic component 30A of the inverter 30 as a heat-generating component is mounted on the inner peripheral surface 142 of the front housing 14 at a position on the opposite side of the wall of the front housing 14 from the inlet pipe 171. Therefore, the heat generated by the electronic component 30A is transferred through the front housing 14 to the inlet pipe 171 and then transferred to the refrigerant gas flowing in the inlet pipe 171, so that the electronic component 30A can be efficiently cooled. In addition, since the cooling of the electronic component 30A is accomplished only by the contact between the inlet pipe 171 and the outer peripheral surface 141 of the front housing 14, the inverter 30 can be freely provided within the accommodation space K of the front housing 14. As a result, arrangement of the circuit board 301 and the electronic components 30A and 30B in the inverter 30 becomes easy, and design freedom in the inverter 30 can be expanded.

(2) After being introduced into the intermediate housing 12 via the inlet port 17, refrigerant gas flows through the inside of the motor 19, so that the refrigerant gas is warmed by the motor 19. In the embodiment, the electronic component 30A is mounted on the inner peripheral surface 142 of the front housing 14 at a position on the opposite side of the wall of the front housing 14 from the inlet pipe 171. Therefore, the electronic component 30A can be cooled by cool refrigerant gas before being introduced into the intermediate housing 12. As a result, the electronic component 30A can be more efficiently cooled, as compared to a case wherein the electronic component 30A is cooled by refrigerant gas after being introduced into the intermediate housing 12.

(3) Since the part of the inlet pipe 171, which is in contact with the outer peripheral surface 141 of the front housing 14, is formed so as to extend straight in the axial direction of the rotary shaft 23, cooling of the electronic component 30A can be easily accomplished.

(4) Since the accommodation space K is formed only by connecting the front housing 14 to the intermediate housing 12, no machining process is required to provide the space K, resulting in high productivity in manufacturing of the compressor 10.

Figure 3:
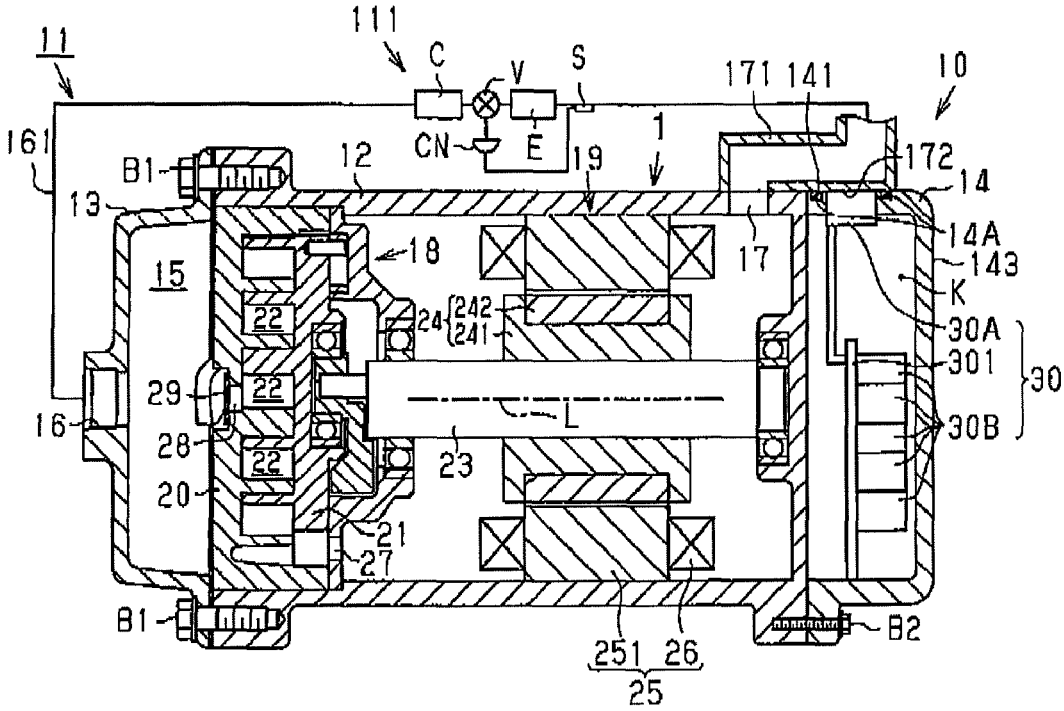
FIG. 3 is a longitudinal cross-sectional view of a motor-driven compressor according to a second embodiment of the present invention.

The following will describe the second embodiment of the present invention with reference to FIG. 3. In FIG. 3, same reference numbers are used for the common elements or components in the first and second embodiments, and the description of such elements or components for the second embodiment will be omitted.

Referring to FIG. 3, the electronic component 30A of the inverter 30 is mounted in a through-hole of the front housing 14 so as to be in direct contact with the outer peripheral surface 172 of the inlet pipe 171. That is, the electronic component 30A is thermally coupled to the inlet pipe 171. In the compressor 10 of the second embodiment, a seal member 14A is provided around the electronic component 30A for sealing between the inlet pipe 171 and the outer peripheral surface 141 of the front housing 14.

The second embodiment offers the following advantages in addition to the advantages of the first embodiment.

(5) Since the electronic component 30A is mounted in the through-hole of the front housing 14 so as to be in direct contact with the outer peripheral surface 172 of the inlet pipe 171, the electronic component 30A can be cooled more efficiently. In the second embodiment, meanwhile, there is a possibility that a part of refrigerant gas flowing in the inlet pipe 171 may flow out into a clearance between the inlet pipe 171 and the outer peripheral surface 141 of the front housing 14. The refrigerant gas then may flow through the clearance toward the electronic component 30A. In addition, water condensed on the outer surface of the inlet pipe 171 due to cool refrigerant gas flowing in the inlet pipe 171 may also flow through the clearance toward the electronic component 30A. In the second embodiment, however, the seal member 14A is provided around the electronic component 30A to seal between the inlet pipe 171 and the outer peripheral surface 141 of the front housing 14. Therefore, the above refrigerant gas or condensed water is prevented from entering into the accommodation space K through a clearance around the electronic component 30A.

Figure 4:
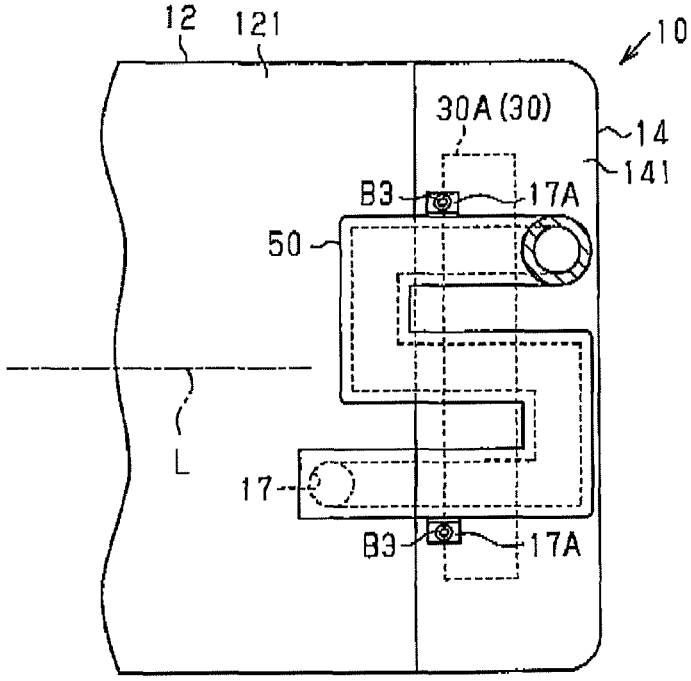
FIG. 4 is a plan view of an inlet pipe according to a third embodiment of the present invention.

The following will describe the third embodiment of the present invention with reference to FIG. 4. In FIG. 4, same reference numbers are used for the common elements or components in the first and third embodiments, and the description of such elements or components for the second embodiment will be omitted.

Referring to FIG. 4, the compressor 10 of the third embodiment includes an inlet pipe 50. The inlet pipe 50 is connected at one end thereof to the inlet port 17 and at the other end thereof to the outlet of the evaporator E (see FIG. 2). Part of the inlet pipe 50 adjacent to the one end thereof extends straight from the inlet port 17 toward the front housing 14, then extends in the circumferential direction of the front housing 14, and then extends toward the intermediate housing 12. The inlet pipe 50 further extends in the circumferential direction of the intermediate housing 12 and then extends straight toward the front housing 14 again. That is, part of the inlet pipe 50, which is in contact with the outer peripheral surface 121 of the intermediate housing 12 and the outer peripheral surface 141 of the front housing 14, has a serpentine shape or a shape similar to S shape in plan view. The inlet pipe 50 is provided with two L-shaped brackets 17A, as the inlet pipe 171 described in the first embodiment. Each bracket 17A is mounted on the outer peripheral surface 141 of the front housing 14 by using the bolt BS, so that the inlet pipe 50 is fixedly mounted on the front housing 14.

The third embodiment offers the following advantages in addition to the advantages of the first embodiment.

(6) The part of the inlet pipe 50, which is in contact with the outer peripheral surface 121 of the intermediate housing 12 and the outer peripheral surface 141 of the front housing 14, has a serpentine shape or an S shape. Therefore, the inlet pipe 50 can be disposed adjacent to the electronic component 30A via the front housing 14 over a larger area, and the electronic component 30A can be cooled more efficiently, accordingly.

The above embodiments may be modified in various ways as exemplified below.

In the third embodiment, the inlet pipe 50 has an S shape in plan view, but it may have a W shape. That is, the shape of the inlet pipe 50 may be modified in any ways depending on various factors such as the arrangement of the inlet pipe 50 and the positional relationship between the compressor 10 and a surrounding device.

In each embodiment, the electronic component 30A as a heat-generating component disposed adjacent to the inlet pipe 171 or 50 is a switching device. Alternatively, the electronic component 30A may be of any other heat-generating components such as a diode.

In each embodiment, the compression mechanism 18, the motor 19 and the inverter 30 are aligned in this order in the axial direction of the rotary shaft 23. Alternatively, the motor 19, the compression mechanism 18 and the inverter 30 may be aligned in this order in the axial direction of the rotary shaft 23.

In each embodiment, the compression mechanism 18 is of a scroll type having the fixed and movable scrolls 20 and 21, but it may be of a piston type or a vane type.

Therefore, the present examples and embodiments are to be considered as illustrative and not restrictive, and the invention is not to be limited to the details given herein but may be modified within the scope of the appended claims.

What is claimed is:

1. A motor-driven compressor to be connected to an external refrigerant circuit, comprising:

a housing including an intermediate housing and a front housing connected to the intermediate housing, the intermediate housing having an inlet port adjacent to the front housing;

a compression mechanism accommodated in the intermediate housing for compression of refrigerant introduced from the external refrigerant circuit via the inlet port into the intermediate housing;

an inverter accommodated in the front housing and having a heat-generating component;

an electric motor accommodated in the intermediate housing and driven by the inverter; and a rotary shaft rotated by the electric motor to drive the compression mechanism, wherein the compression mechanism, the electric motor, and the inverter are aligned in order in an axial direction of the rotary shaft, the intermediate housing is positioned next to the front housing in the axial direction, and an inlet pipe is connected to the inlet port; wherein the inlet pipe extends in the axial direction from the inlet port along and in contact with outer peripheral surfaces of both the intermediate housing and the front housing, and the heat-generating component of the inverter is disposed adjacent to or in contact with the inlet pipe so as to be thermally coupled to the inlet pipe.

2. The motor-driven compressor according to claim 1, wherein the heat-generating component is mounted on an inner peripheral surface of the front housing so as to be thermally coupled to the inlet pipe via a wall of the front housing.

3. The motor-driven compressor according to claim 2, wherein the heat-generating component is mounted on the opposite side of the wall of the front housing from the inlet pipe.

4. The motor-driven compressor according to claim 1, wherein the heat-generating component is mounted in a through-hole of the front housing so as to be in direct contact with the inlet pipe, and a seal member is provided around the heat-generating component for sealing the heat-generating component from outside of the front housing.

5. The motor-driven compressor according to claim 4, wherein the seal member is provided between the inlet pipe and the outer peripheral surface of the front housing.

6. The motor-driven compressor according to claim 1, wherein part of the inlet pipe in contact with the outer peripheral surfaces of both the intermediate housing and the front housing is formed so as to extend straight.

7. The motor-driven compressor according to claim 1, wherein part of the inlet pipe in contact with the outer peripheral surfaces of both the intermediate housing and the front housing has a serpentine shape.

* * * * *